US012807274B2

(12) United States Patent
Dougherty

(10) Patent No.: US 12,807,274 B2
(45) Date of Patent: Nov. 24, 2026

(54) APPARATUS AND METHOD FOR A CATAMARAN HULL WITH STAGGERED KEEL

(71) Applicant: Stephen Dougherty, Edgewater, FL (US)

(72) Inventor: Stephen Dougherty, Edgewater, FL (US)

( * ) Notice: Subject to any disclaimer, the term of this patent is extended or adjusted under 35 U.S.C. 154(b) by 118 days.

(21) Appl. No.: 18/906,906

(22) Filed: Oct. 4, 2024

(65) Prior Publication Data

US 2025/0115333 A1 Apr. 10, 2025

Related U.S. Application Data

(60) Provisional application No. 63/542,426, filed on Oct. 4, 2023.

(51) Int. Cl.
*B63B 1/12* (2006.01)
*B63B 1/18* (2006.01)
*B63B 1/20* (2006.01)

(52) U.S. Cl.
CPC ..... *B63B 1/18* (2013.01); *B63B 1/121* (2013.01); *B63B 1/20* (2013.01); *B63B 2001/186* (2013.01); *B63B 2001/202* (2013.01)

(58) Field of Classification Search
CPC .. B63B 3/38; B63B 1/18; B63B 1/121; B63B 1/20; B63B 2001/186; B63B 2001/202
USPC ..... 114/291, 61.1, 61.2, 61.21, 61.32, 140, 114/149
See application file for complete search history.

(56) References Cited

U.S. PATENT DOCUMENTS 3,902,445 A * 9/1975 Stolk ..... B63B 1/20 114/62
4,224,889 A * 9/1980 Spiegel ..... B63B 1/12 114/291

* cited by examiner

*Primary Examiner* — Anthony D Wiest
(74) *Attorney, Agent, or Firm* — Perilla Knox & Hildebrandt

(57) ABSTRACT

The invention relates to a catamaran hull to improve performance characteristics. The catamaran hull comprises a staggered keel and varying deadrise angles to reduce hunting phenomena and improve sea-keeping, handling, and turning abilities of the catamaran. The hull includes a forward keel centered on each sponson, a mid keel moved inward relative to the forward keel, and an aft keel moved inward relative to the mid keel. This catamaran hull provides a solution that reduces undesirable phenomena such as hunting and outward leaning during turns, while improving stability and maneuverability. Overall, it offers enhanced performance in various water conditions through its unique staggered keel configuration and optimized hull geometry.

13 Claims, 7 Drawing Sheets

APPARATUS AND METHOD FOR A CATAMARAN HULL WITH STAGGERED KEEL

RELATED APPLICATIONS

This application claims priority to U.S. Application No. 63/542,426, titled SYSTEM, APPARATUS AND METHOD FOR A CATAMARAN BOAT HULL, filed on 4 Oct. 2023, which is incorporated herein by reference in its entirety, including any addendums, appendixes, and attachments thereto, to the extent these applications do not conflict with the present disclosure herein.

FIELD OF INVENTION

The present disclosure relates to a system, apparatus, and method for a catamaran boat hull with a staggered keel design.

BACKGROUND

The following discussion is not to be deemed admitted prior art, but merely related art to show possible background and information related to devices or systems for securing textiles to fixed surfaces.

Catamarans, as used herein, may be but not limited to, boats with two parallel hulls of equal size, multihull vessels, twin-hulled watercraft, double-hulled boats, and dual-hulled marine vessels.

Performance characteristics, as used herein, may be but not limited to, speed, stability, maneuverability, fuel efficiency, handling in rough waters, turning ability, and resistance to capsizing.

Hunting phenomena, as used herein, may be but not limited to, oscillatory motion of a vessel, zigzag-like path during navigation, overcorrection in response to steering inputs, and undesired yawing motion.

Keels, as used herein, may be but not limited to, structural elements extending along the bottom of a hull, longitudinal fins, centerboards, and stabilizing protrusions on the underside of a boat.

Deadrise angles, as used herein, may be but not limited to, the angle between the bottom of a hull and a horizontal plane, hull slope from keel to chine, and transverse inclination of a boat's running surface.

To illustrate examples of potential embodiments without limiting their scope, the following description will discuss using staggered keels and varying deadrise angles in catamaran hulls to improve performance characteristics. Forward, mid, and aft keels on sponsons are used as examples, but it should be understood that the invention can be applied to other hull configurations and keel arrangements.

Catamarans are widely used in recreational and commercial marine applications due to their stability, speed, and efficiency compared to single-hulled vessels. The twin-hull design of catamarans provides increased lateral stability and reduced drag, allowing for improved performance in various water conditions. However, despite these inherent advantages, catamaran designers and users continually seek ways to enhance performance characteristics such as speed, maneuverability, and handling.

One problem with traditional catamaran designs is their tendency to slide outward during turns, similar to an uncoordinated turn in an aircraft where roll and yaw are not working together. This behavior can result in reduced control and efficiency, particularly in high-speed or rough water conditions. Additionally, some catamaran designs may experience the "hunting" phenomenon, where the vessel overcorrects to steering inputs, resulting in a zigzag-like path instead of smooth, direct lines or arcs.

Typically, a solution to improve catamaran performance is to install a larger engine, which increases the power and torque of the boat, allowing it to move faster and more efficiently. However, this approach often leads to increased fuel consumption and may not address underlying hydrodynamic issues.

Still, other solutions involve upgrading the propeller to a larger size, enabling the catamaran to move faster and more efficiently, especially in rough waters. While this can provide some performance benefits, it may not fully address handling and stability concerns.

Another common approach is to adjust the trim tabs, which can help modify the angle of the boat relative to the water, potentially increasing its speed and efficiency. However, trim tab adjustments alone may not sufficiently improve overall performance characteristics, particularly in terms of turning ability and stability.

Each of these solutions fails to meet the needed solution because they may not comprehensively address the complex interplay of factors affecting catamaran performance. Larger engines and propellers can increase speed but may exacerbate handling issues, while trim tab adjustments offer limited improvements in overall performance. Furthermore, these solutions do not directly address the fundamental hull design aspects that influence a catamaran's hydrodynamic properties.

Therefore, a need exists for a novel system, apparatus, and method for a catamaran hull to improve performance characteristics.

BRIEF SUMMARY OF THE INVENTION

This invention relates to a catamaran hull designed to improve performance characteristics and handling.

Numerous aspects of a unique catamaran hull for providing improved stability, maneuverability, and efficiency are disclosed.

It is desirable to have a catamaran hull to reduce hunting phenomena, improve sea-keeping abilities, provide a drier ride, and enhance handling and turning capabilities. Additionally, it allows for optimized performance across varying hull sizes and eliminates outward leaning during turns.

The disclosed catamaran hull advantageously fills these needs and addresses the aforementioned deficiencies by providing a catamaran hull with a staggered keel configuration and varying deadrise angles to achieve superior performance and handling characteristics.

BRIEF DESCRIPTION OF THE DRAWINGS

A system, apparatus, and method for a catamaran hull is illustrated by way of example, and not by way of limitation, in the figures of the accompanying drawings.

While aspects of a system, apparatus, and method for a catamaran hull will be described with reference to the details of the embodiments of the invention shown in the drawings (and some embodiments not shown in the drawings), these details are not intended to limit the scope of the invention.

LIST OF FIGURE ITEMS

Figure 1:
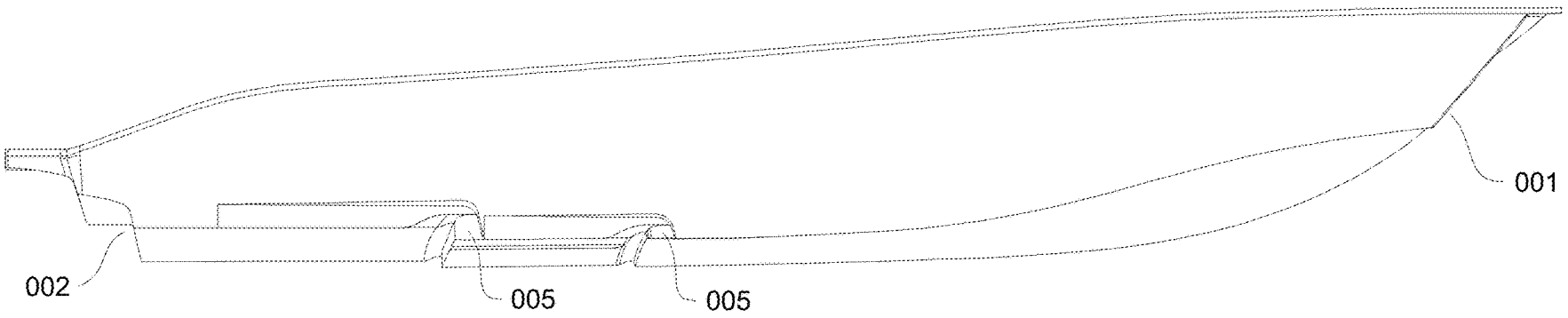
FIG. 1. A side view of a catamaran hull with transverse steps, according to aspects of the present disclosure.

001 Bow
002 Stern
003 Forward Keel
004 Mid Keel
005 Transverse Step
006 Aft Keel
007 Transom
008 Keel
009 Outer Chine
010 Tunnel
012 Waterline

DETAILED DESCRIPTION

The order of the steps in the disclosed processes may be altered within the scope of the invention.

In conjunction with the accompanying drawings, the following detailed description provides a more specific and detailed explanation of various embodiments of the system, apparatus, and method for a catamaran hull. These embodiments are provided to illustrate the invention but should not be seen as limiting its scope; the invention can be embodied in many different forms and is intended to be thorough and comprehensive to those skilled in the art.

For the purposes of promoting an understanding of the principles of a system, apparatus, and method for a catamaran hull, reference will now be made to the embodiments illustrated in the drawings and specific language will be used to describe the same, only as examples and not intended to be limiting.

A catamaran hull may come in varying sizes and shapes, depending on the intended use and design specifications. The overall length of a catamaran hull can range from small recreational boats of about 16 feet (4.9 meters) to large commercial vessels exceeding 100 feet (30.5 meters). The width, or beam, of a catamaran hull is typically proportional to its length, often ranging from 30% to 50% of the overall length.

A catamaran hull may be constructed from various materials, including but not limited to fiberglass, carbon fiber, aluminum, steel, and wood. The choice of material depends on factors such as weight requirements, durability needs, and manufacturing processes.

The bow 001 of a catamaran hull may be designed with different shapes, such as a sharp V-shape for cutting through waves, a more rounded shape for increased buoyancy, or a wave-piercing design for improved efficiency at high speeds. The stern 002 may feature a square transom, a rounded design, or a tapered shape to optimize water flow and reduce drag.

The catamaran hull of the present invention features a unique design with staggered keels and varying deadrise angles. The hull comprises a symmetrical shape forward, with keels on sponson centerlines, and at each transverse step resulting in the keel. As the hull progresses towards the stern, the keel staggers a distance closer to the hull's center-line, creating an asymmetrical sponson configuration in the stern.

A forward keel 003 may extend along the bottom of each sponson, typically positioned at the centerline of the sponson. The length of the forward keel can vary but often extends from the bow to the first transverse step. The depth and profile of the forward keel may be designed to provide stability and improve tracking in various sea conditions.

Figure 4:
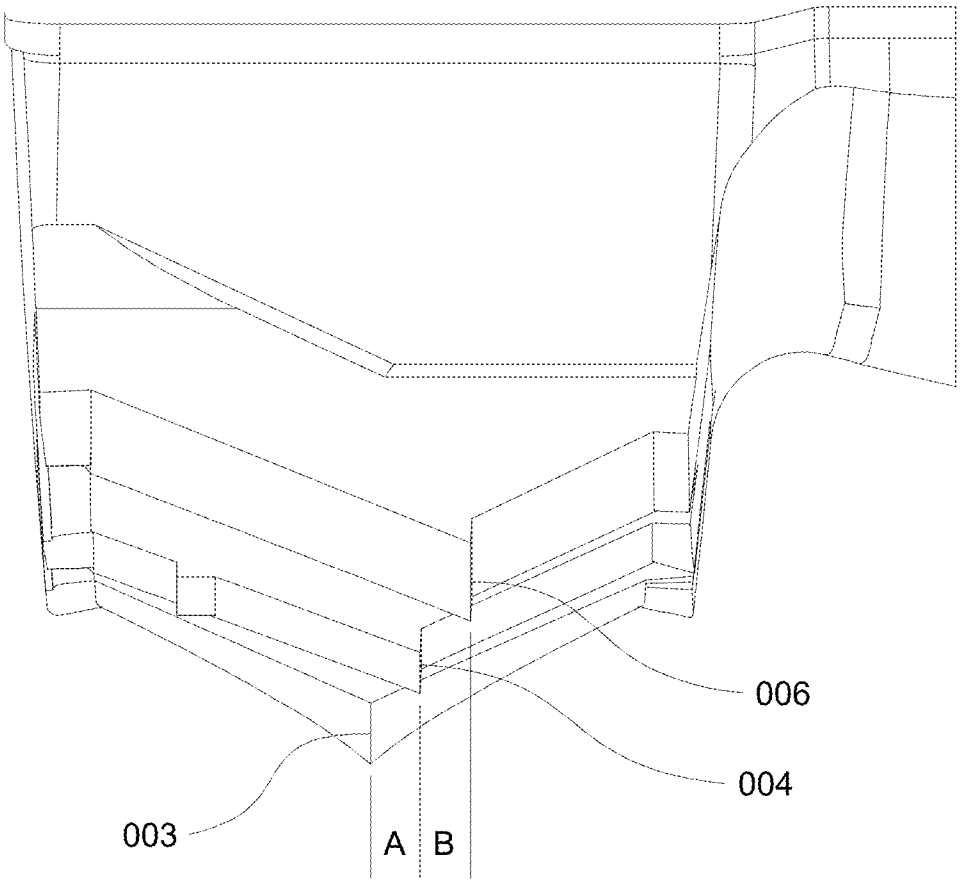
FIG. 4. A planar view from stern to bow of a catamaran hull portion, according to an embodiment.

A mid keel 004 may be positioned aft of the forward keel, beginning at the forward transverse step 005 and ending at the aft transverse step. The mid keel is typically offset inward from the forward keel a distance "A" (FIG. 4). The distance "A" is calculated based on the length of the vessel. In some embodiments "A" could may be in a range, not meant to be limiting, of 1% to 50% of the longitudinal length of the particular keel. This inward offset contributes to the staggered keel configuration, which can improve handling characteristics.

An aft keel 006 may be located at the rear portion of each sponson, extending from the aft transverse step to the stern. Similar to the mid keel, the aft keel is typically offset inward from the mid keel by a distance "B" (FIG. 4). The distance "B" is calculated based on the length of the vessel. In some embodiments "B" could may be in a range, not meant to be limiting, of 1% to 50% of the longitudinal length of the particular keel. This further staggering of the keel can enhance turning performance and reduce the tendency of the catamaran to lean outward during turns.

Transverse steps 005 may be incorporated into the hull design to reduce wetted surface area and improve hydrodynamic efficiency. These steps can vary in number, typically ranging from one to three per sponson, and their positioning along the hull length can be optimized for specific performance characteristics.

The chine 009 of a catamaran hull may be designed with varying angles and shapes to influence water flow and spray characteristics. Chine configurations can include hard chines with a sharp angle between the bottom and sides of the hull, or softer, more rounded chines for different performance attributes.

A tunnel 010 formed between the two sponsons of a catamaran hull can vary in shape and size. The tunnel may be designed with a specific height-to-width ratio to optimize air and water flow, potentially incorporating features such as air induction systems or stepped surfaces to enhance performance.

The deadrise angle of a catamaran hull, which is the angle between the bottom of the hull and a horizontal plane, may vary along the length of each sponson. Forward sections often have higher deadrise angles for better wave-cutting ability, while aft sections may have lower angles to improve planing efficiency. The specific angles can range from nearly flat (0-5 degrees) to deep-V configurations (20-25 degrees or more), depending on the desired performance characteristics.

The present disclosure provides a catamaran hull designed to enhance performance characteristics and handling in various water conditions. The catamaran hull may incorporate a staggered keel configuration and varying deadrise angles, which can contribute to improved stability, maneuverability, and efficiency. The staggered keel configuration may include a forward keel, a mid keel, and an aft keel, each positioned at different locations along the length of the hull and offset inward from one another. This unique configuration can help reduce the tendency of the catamaran to lean outward during turns, a common issue with traditional catamaran designs.

In addition, the varying deadrise angles along the length of the hull can further enhance the catamaran's performance. Higher deadrise angles in the forward sections may improve wave-cutting ability, while lower angles in the aft sections may enhance planing efficiency. These features, in combination, can address the problem of hunting phenomena, where the vessel overcorrects to steering inputs, resulting in a zigzag-like path instead of smooth, direct lines or arcs.

The catamaran hull may also incorporate other design elements such as transverse steps, a chine, and a tunnel, each contributing to the overall hydrodynamic efficiency and performance of the catamaran. The transverse steps can reduce the wetted surface area, the chine can influence water flow and spray characteristics, and the tunnel can optimize air and water flow.

In some embodiments, the catamaran hull may be constructed from various materials and come in varying sizes and shapes, depending on the intended use and design specifications. The choice of material and design can further contribute to the catamaran's performance characteristics, providing a versatile and efficient solution for both recreational and commercial marine applications.

The staggered keel design is implemented as follows: (1) The forward keel 003 is centered on the sponson; (2) the mid keel 004 begins longitudinally at the forward transverse step 005 and ends at the after transverse step 005; (3) the mid keel 004 is moved inward relative to the forward keel 003 toward the center of the hull and away from the outer edge of the sponson by a distance "A" (FIG. 4); (4) the aft keel 006 begins longitudinally at the aft transverse step 005 and ends at the stern; (5) the aft keel 006 is moved inward relative to the mid keel 004 toward the center of the hull and away from the other edge of the sponson by a distance "B" (FIG. 4).

This progressive inward movement of the keels from bow to stern creates the staggered keel configuration that contributes to the improved performance characteristics of the catamaran hull.

Referring to FIG. 1, a side view of a catamaran hull is illustrated. The hull comprises a bow 001 at the front end and a stern 002 at the rear end. The overall shape of the hull shows a gradual curve from the bow 001 to the stern 002, contributing to its streamlined profile. This profile may be designed to optimize hydrodynamic performance, potentially enhancing the speed and efficiency of the catamaran in various water conditions.

In some embodiments, the hull features two transverse steps 005 along its bottom surface. These transverse steps 005 are positioned between the bow 001 and stern 002, creating distinct sections along the hull's length. The transverse steps 005 appear as indentations or breaks in the hull's bottom profile, potentially affecting the hull's hydrodynamic properties. The positioning and number of these transverse steps 005 may vary depending on the specific design requirements of the catamaran. In some embodiments, the transverse steps 005 may be designed to reduce the wetted surface area of the hull, potentially improving the catamaran's speed and fuel efficiency.

In some embodiments, each sponson of the catamaran hull may feature at least one transverse step 005. The transverse step 005 may be positioned at a specific location along the length of the sponson, such as between the forward keel and the mid keel. The positioning of the transverse step 005 may be designed to influence the hydrodynamic performance of the sponson, potentially affecting characteristics such as stability, speed, and maneuverability.

In some embodiments, the transverse step 005 may be designed with a specific shape and size to optimize its hydrodynamic effects. For example, the transverse step 005 may feature a sharp, angular design to reduce drag, or a more rounded design to enhance stability. The specific design of the transverse step 005 may be determined based on factors such as the intended use of the catamaran, the expected water conditions, and the desired performance characteristics.

Figure 2:
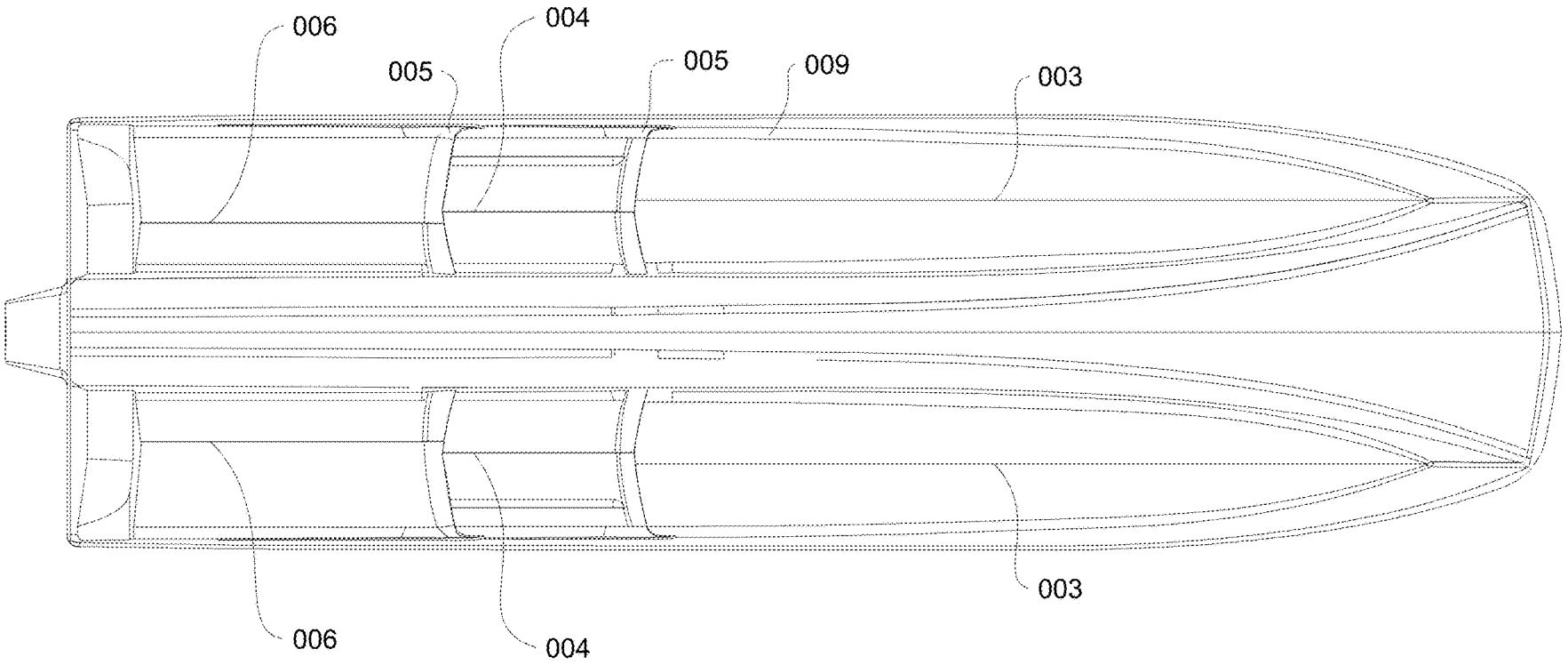
FIG. 2. An underside view of a catamaran hull showing sponsons and keels, according to an embodiment.

Referring to FIG. 2, an underside view of a catamaran hull is illustrated. The hull comprises two parallel sponsons, each featuring a unique arrangement of keels and transverse steps. In some embodiments, each sponson of the catamaran hull may include a forward keel 003, a mid keel 004, and an aft keel 006. These keels may be strategically positioned along the length of each sponson to optimize the performance characteristics of the catamaran.

In some embodiments, the forward keel 003 may be positioned at the front of each sponson, extending towards the bow. This forward keel 003 may be designed to provide stability and improve tracking in various sea conditions. The mid keel 004 may be located in the middle section of each sponson, positioned inward relative to the forward keel 003 towards the center of the hull. This inward positioning of the mid keel 004 may contribute to the unique staggered keel configuration of the catamaran hull, potentially enhancing its handling characteristics.

In some embodiments, the aft keel 006 may be situated at the rear of each sponson, near the stern. The aft keel 006 may be positioned further inward relative to the mid keel 004, contributing to the staggered arrangement of the keels. This further inward positioning of the aft keel 006 may enhance the turning performance of the catamaran, potentially reducing the tendency of the catamaran to lean outward during turns.

In some embodiments, the catamaran hull may also incorporate at least one transverse step 005 on each sponson. The transverse step 005 may be positioned between the forward keel 003 and the mid keel 004, creating a distinct section along the length of each sponson. This transverse step 005 may appear as an indentation or break in the hull's bottom profile, potentially affecting the hull's hydrodynamic properties. The positioning and design of the transverse step 005 may be optimized to reduce the wetted surface area of the hull, potentially improving the speed and efficiency of the catamaran.

Referring to FIG. 2, the specific positioning and arrangement of the forward keel 003, mid keel 004, and aft keel 006 on each sponson is illustrated. In some embodiments, the forward keel 003 is centered on the sponson, extending longitudinally from the bow towards the first transverse step 005. This positioning of the forward keel 003 may be designed to provide stability and improve tracking in various sea conditions.

In some embodiments, the mid keel 004 begins longitudinally at the forward transverse step 005 and ends at the after transverse step 005. The mid keel 004 is positioned inward relative to the forward keel 003 towards the center of the hull. This inward positioning of the mid keel 004 contributes to the unique staggered keel configuration of the catamaran hull, potentially enhancing its handling characteristics.

In some embodiments, the aft keel 006 begins longitudinally at the aft transverse step 005 and ends at the stern. The aft keel 006 is positioned further inward relative to the mid keel 004 towards the center of the hull. This further inward positioning of the aft keel 006 may enhance the turning performance of the catamaran, potentially reducing the tendency of the catamaran to lean outward during turns.

In some embodiments, the staggered keel configuration may be designed to optimize the performance characteristics of the catamaran hull. The specific positioning and arrangement of the forward keel 003, mid keel 004, and aft keel 006 may be determined based on factors such as the intended use of the catamaran, the expected water conditions, and the desired performance characteristics.

Figure 3:
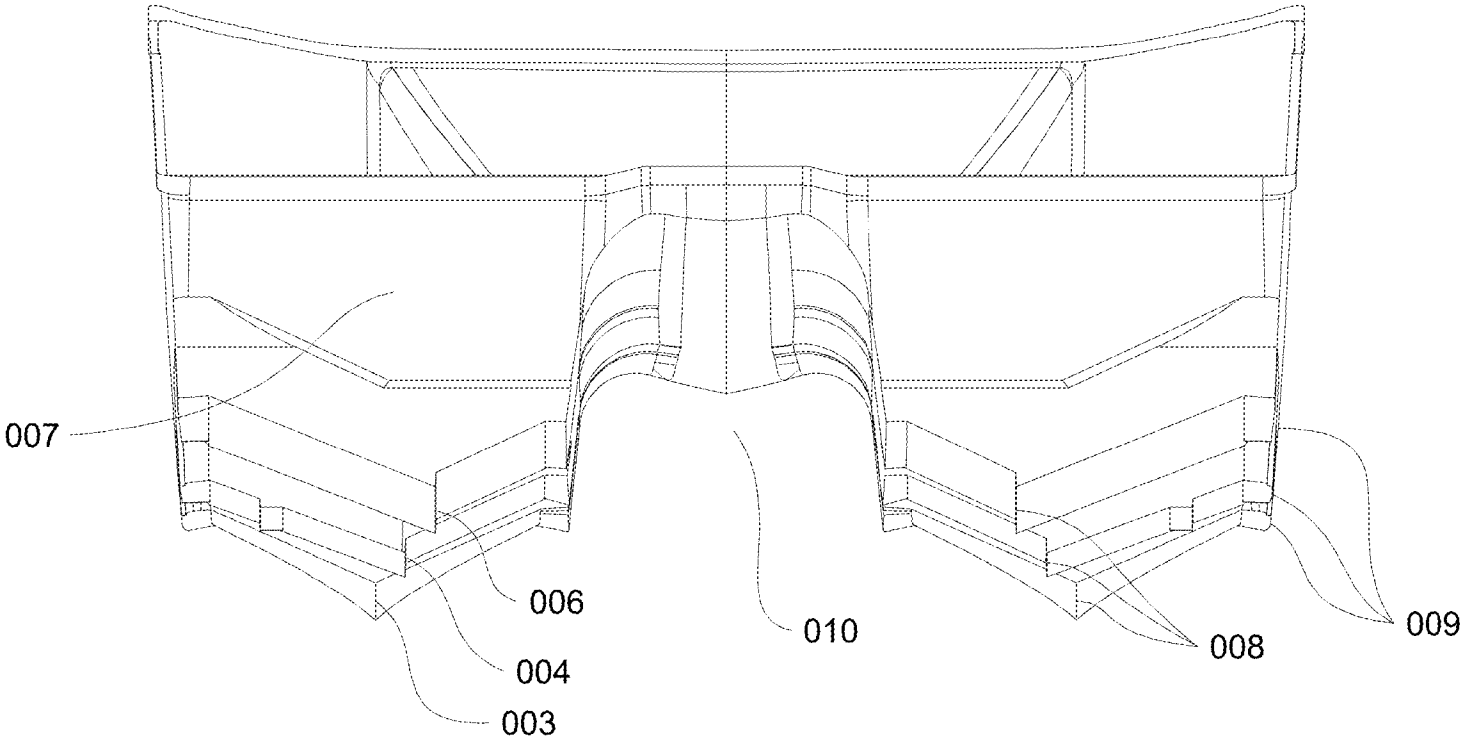
FIG. 3. A rear view of a catamaran hull illustrating the staggered keel design, according to aspects of the present disclosure.

Referring to FIG. 3, a rear view of a catamaran hull is illustrated. The figure depicts two parallel sponsons connected by a central structure, forming the catamaran configuration. Each sponson of the catamaran hull may include a forward keel 003, a mid keel 004, and an aft keel 006. These keels are positioned at different points along the bottom of each sponson, creating a stepped profile that may contribute to the hull's hydrodynamic performance.

In some embodiments, the staggered keel design is visible in the arrangement of the forward keel 003, mid keel 004, and aft keel 006. The forward keel 003 is positioned at the front of each sponson, extending towards the bow. The mid keel 004 is located in the middle section of each sponson, positioned inward relative to the forward keel 003. The aft keel 006 is situated at the rear of each sponson, positioned further inward relative to the mid keel 004. This staggered arrangement of the keels is designed to influence the hull's performance characteristics.

In some embodiments, a tunnel 010 is formed between the two sponsons, which can facilitate water and air flow beneath the hull. This tunnel design is a characteristic feature of catamarans, potentially enhancing speed and stability. The tunnel 010 may be configured to optimize air and water flow, potentially improving the catamaran's speed and efficiency.

In some embodiments, each sponson of the catamaran hull may have varying deadrise angles along its length. The deadrise angle, which is the angle between the bottom of the hull and a horizontal plane, may be higher in a forward section of each sponson and lower in an aft section of each sponson. This variation in deadrise angles can influence the hull's stability, speed, and handling characteristics.

In some embodiments, the transom 007 is visible at the rear of the hull, forming the stern structure of the catamaran. The transom 007 provides structural integrity to the hull and serves as the mounting point for propulsion systems or other equipment.

Overall, the rear view of the catamaran hull as depicted in FIG. 3 provides a clear visualization of the staggered keel design and other unique features of the hull structure, demonstrating the innovative approach to optimizing performance characteristics such as stability, speed, and maneuverability in various water conditions.

Referring to FIG. 4, a planar view of a portion of a catamaran hull is illustrated, looking forward from stern to bow. This view provides a clear representation of the staggered keel configuration within the hull structure. The forward keel 003 is shown at the centerline of the sponson. Moving rearward toward the stern, the mid keel 004 is positioned inward relative to the forward keel 003. This inward positioning of the mid keel 004 contributes to the unique staggered keel configuration of the catamaran hull, potentially enhancing its handling characteristics.

Further towards the stern, the aft keel 006 is positioned even more inward relative to the mid keel 004. This further inward positioning of the aft keel 006 may enhance the turning performance of the catamaran, potentially reducing the tendency of the catamaran to lean outward during turns. This staggered arrangement of the keels is clearly visible in the cross-sectional view, demonstrating the progressive inward positioning of the keels from stern to bow.

In some embodiments, the hull structure surrounding the keels is also depicted, showing the varying angles and contours of the sponson's bottom surface. The figure illustrates how the hull's shape changes from the bow section to the stern section, with the keels positioned at different points along this changing profile.

In some embodiments, the inward offset of the mid keel 004 relative to the forward keel 003 and the aft keel 006 relative to the mid keel 004 may be measured as a percentage of the submerged distance of the waterline. This measurement, indicated by Labels A and B in the figure, provides a quantitative representation of the staggered keel configuration. The specific percentage values for these offsets may be determined based on factors such as the intended use of the catamaran, the expected water conditions, and the desired performance characteristics.

In other embodiments, the staggered keel configuration may be implemented in different ways. For example, the mid keel 004 and aft keel 006 may be positioned at different offsets relative to the forward keel 003, or the offsets may be adjusted based on specific performance requirements. This flexibility in the design of the staggered keel configuration allows for the optimization of the catamaran hull's performance characteristics in various water conditions.

Figure 5:
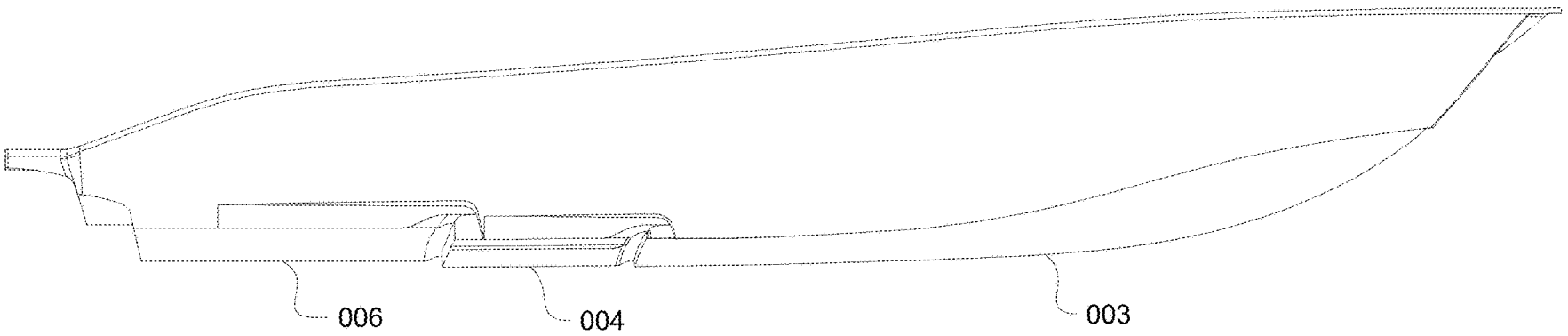
FIG. 5. A side view of a catamaran hull showcasing the staggered keel configuration, according to aspects of the present disclosure.

Referring to FIG. 5, a side view of a catamaran hull is illustrated. The hull comprises a bow 001 at the front end and a stern 002 at the rear end. The overall shape of the hull shows a gradual curve from the bow 001 to the stern 002, contributing to its streamlined profile. This profile may be designed to optimize hydrodynamic performance, potentially enhancing the speed and efficiency of the catamaran in various water conditions.

In some embodiments, the hull features three distinct keel sections: a forward keel 003, a mid keel 004, and an aft keel 006. The forward keel 003 is positioned at the front of the hull, extending from the bow area. Moving towards the stern, the mid keel 004 is situated in the central portion of the hull. The aft keel 006 is located at the rear section of the hull, closest to the stern. The staggered arrangement of these keels is evident, with each subsequent keel positioned slightly inward relative to the previous one. This design creates a stepped profile along the bottom of the hull, which may contribute to the hull's hydrodynamic properties.

In some embodiments, the staggered keel configuration may be designed to optimize the performance characteristics of the catamaran hull. The specific positioning and arrangement of the forward keel 003, mid keel 004, and aft keel 006 may be determined based on factors such as the intended use of the catamaran, the expected water conditions, and the desired performance characteristics.

In some embodiments, the hull's overall shape tapers from bow to stern, with a relatively flat bottom and a raised bow section for improved wave-cutting ability. This tapering shape, in combination with the staggered keel configuration, may contribute to the catamaran's improved stability, maneuverability, and efficiency.

In some embodiments, the staggered keel configuration may be implemented in different ways. For example, the mid keel 004 and aft keel 006 may be positioned at different offsets relative to the forward keel 003, or the offsets may be adjusted based on specific performance requirements. This flexibility in the design of the staggered keel configuration allows for the optimization of the catamaran hull's performance characteristics in various water conditions.

Figure 6:
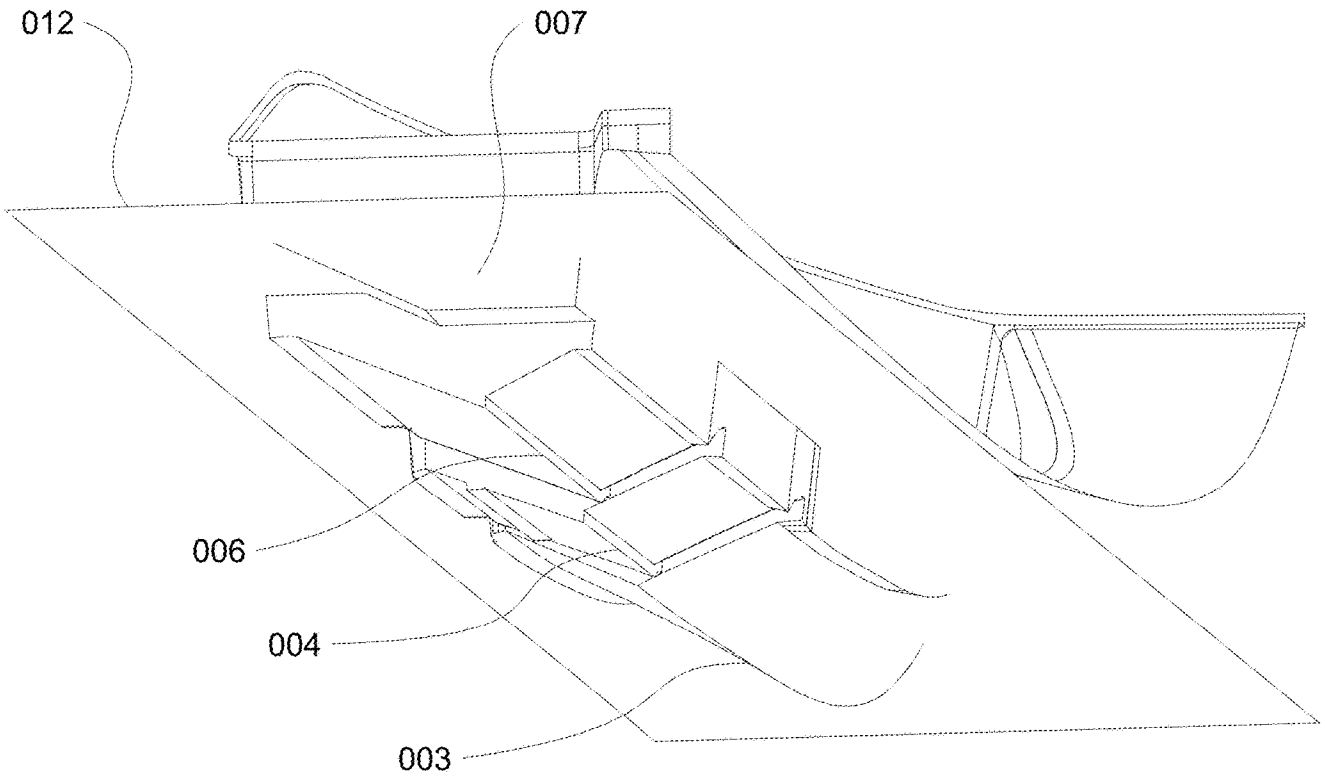
FIG. 6. A perspective view of a catamaran hull sponson with staggered keels, according to an embodiment.

Referring to FIG. 6, a perspective view of a catamaran hull is illustrated. The figure depicts one sponson of the catamaran, with the waterline 012 indicated to show the hull's position relative to the water surface. The hull features a forward keel 003, a mid keel 004, and an aft keel 006. These keels are strategically positioned along the bottom of the sponson to optimize the performance characteristics of the catamaran.

In some embodiments, the mid keel 004 is positioned inward relative to the forward keel 003 towards the center of the hull. This inward positioning of the mid keel 004 contributes to the unique staggered keel configuration of the catamaran hull, potentially enhancing its handling characteristics. The specific inward offset of the mid keel 004 relative to the forward keel 003 may be determined by a percentage of the submerged distance of the waterline 012.

Further towards the stern, the aft keel 006 is positioned even more inward relative to the mid keel 004. This further inward positioning of the aft keel 006 may enhance the turning performance of the catamaran, potentially reducing the tendency of the catamaran to lean outward during turns. The specific inward offset of the aft keel 006 relative to the mid keel 004 may also be determined by a percentage of the submerged distance of the waterline 012.

At the rear of the sponson, the transom 007 is depicted, forming the stern structure of the catamaran. The transom 007 provides structural integrity to the hull and serves as the mounting point for propulsion systems or other equipment.

The waterline 012 is represented by a horizontal line, indicating the level at which the hull meets the water surface when the catamaran is at rest. This line helps to visualize the hull's draft and how the staggered keel configuration interacts with the water.

The perspective view allows for a clear visualization of how the forward keel 003, mid keel 004, and aft keel 006 are positioned relative to each other and the overall hull structure. This arrangement demonstrates the unique design of the catamaran hull, which aims to enhance stability, reduce drag, and improve handling characteristics in various water conditions.

Figure 7:
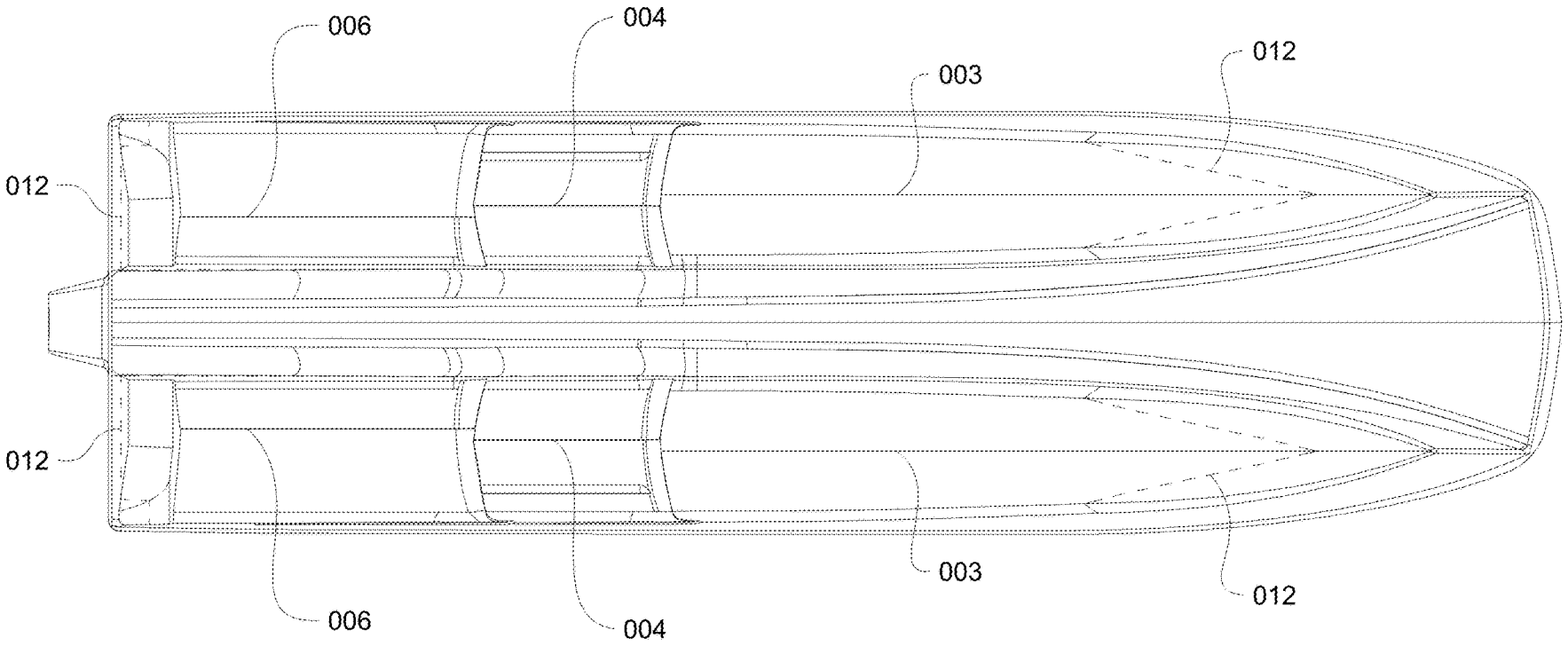
FIG. 7. A top view of a catamaran hull depicting the keel arrangement and waterline, according to aspects of the present disclosure.

Referring to FIG. 7, a top view of a catamaran hull is illustrated. The figure shows the unique staggered keel arrangement and the overall hull configuration, including the tunnel 010 between the sponsons. In some embodiments, each sponson of the catamaran hull may include a forward keel 003, a mid keel 004, and an aft keel 006. These keels are strategically positioned along the length of each sponson to optimize the performance characteristics of the catamaran.

In some embodiments, the forward keel 003 is positioned at the front of each sponson, from the bow to the forward transverse. The mid keel 004 is located in the middle section of each sponson, positioned inward relative to the forward keel 003 towards the center of the hull. The aft keel 006 is situated at the rear of each sponson, positioned further inward relative to the mid keel 004. This staggered arrangement of the keels is designed to influence the hull's performance characteristics.

In some embodiments, the waterline 012 is depicted along the outer edges of both sponsons, indicating the level at which the hull sits in the water. The waterline 012 extends from the bow to the stern, following the contours of the sponsons. This line helps to visualize the hull's draft and how the staggered keel configuration interacts with the water.

In some embodiments, each sponson of the catamaran hull may have a symmetrical forward section and an asymmetrical aft section. This design feature can influence the hull's stability, speed, and handling characteristics. The symmetrical forward section may improve wave-cutting ability, while the asymmetrical aft section may enhance planing efficiency.

In other cases, the space between the two sponsons forms a tunnel 010, which is an integral part of the catamaran's design, affecting its hydrodynamic and aerodynamic properties. The overall shape of the hull tapers from the wider stern to the narrower bow, contributing to its streamlined profile. The tunnel 010 may be designed to optimize air and water flow, potentially improving the catamaran's speed and efficiency.

In some embodiments, the catamaran hull may be designed to reduce the phenomena known as "hunting". Hunting is a condition where the hull overcorrects to the captain's inputs, resulting in a zigzag-like path instead of direct lines or arcs. This can be a common issue with traditional catamaran designs, potentially affecting the vessel's performance and handling. The staggered keel configuration and varying deadrise angles of the catamaran hull may help to mitigate this issue, providing a smoother and more predictable response to steering inputs.

In some embodiments, the catamaran hull may be designed to eliminate a "wet ride". A wet ride is a condition where water spray is pushed up from under the hull and onto the deck or into the cockpit, potentially affecting the comfort and safety of the passengers. This can be a common issue with traditional catamaran designs, particularly those with an asymmetrical forward section. The staggered keel configuration and varying deadrise angles of the catamaran hull may help to mitigate this issue, directing water flow away from the deck and cockpit areas.

In some embodiments, the catamaran hull may be designed to lean into turns rather than outward. Leaning outward during turns can be a common issue with traditional catamaran designs, potentially affecting the vessel's stability and handling. The staggered keel configuration and varying deadrise angles of the catamaran hull may help to mitigate this issue, providing a more balanced and controlled response during turns.

In some embodiments, the catamaran hull may be designed to improve sea-keeping abilities. Sea-keeping refers to the ability of a vessel to maintain course and speed in various sea conditions. This can be a critical performance characteristic for catamarans, particularly those used for recreational or commercial purposes. The staggered keel configuration and varying deadrise angles of the catamaran hull may help to enhance its sea-keeping abilities, providing a smoother and more stable ride in various sea conditions.

In other cases, the catamaran hull may be designed to provide a dryer ride. A dryer ride refers to the ability of a vessel to minimize water spray and wave impact on the deck and cockpit areas. This can be a desirable characteristic for catamarans, particularly those used for recreational activities such as fishing or sailing. The staggered keel configuration and varying deadrise angles of the catamaran hull may help to provide a dryer ride, reducing water spray and wave impact on the deck and cockpit areas.

In some embodiments, the catamaran hull may include additional features designed to enhance its performance and handling characteristics. For example, the catamaran hull may incorporate an inductor air-intake system, typically located in the tunnel 010 between the sponsons. The inductor air-intake system may be designed to create a low-pressure area in the tunnel 010, enabling the catamaran to utilize the venturi effect to increase its speed. This system may be particularly beneficial in high-speed applications, potentially improving the catamaran's efficiency and performance in various water conditions.

In some embodiments, the catamaran hull may be designed to improve handling and turning abilities. The staggered keel configuration and varying deadrise angles may contribute to this improved handling, providing a more balanced and controlled response during turns. The catamaran hull may lean into turns rather than outward, a common issue with traditional catamaran designs. This inward leaning during turns can enhance the catamaran's stability and maneuverability, potentially providing a smoother and more predictable ride.

In some embodiments, the catamaran hull may be designed to optimize performance characteristics in various water conditions. The unique combination of the staggered keel configuration, varying deadrise angles, inductor air-intake system, and integrated hull components may contribute to this optimized performance. These features, in combination, can address common issues with traditional catamaran designs, such as hunting phenomena, wet rides, and outward leaning during turns, providing a versatile and efficient solution for both recreational and commercial marine applications.

In some embodiments, the manufacturing process of a catamaran with a staggered keel configuration may involve several steps to ensure precise implementation of the design. The process may begin with the creation of a mold that accurately represents the desired hull shape, including the staggered keel configuration. This mold may be designed using computer-aided design (CAD) software to ensure precise dimensions and angles for the forward keel 003, mid keel 004, and aft keel 006.

In some embodiments, the hull may be constructed using a layup process, where layers of fiberglass, carbon fiber, or other composite materials are applied to the mold. The staggered keel configuration may be achieved by carefully controlling the thickness and placement of these layers. For the forward keel 003, additional layers may be applied to add strength. As the layup process moves towards the mid keel 004, the layers may be adjusted to create the inward offset. Similarly, for the aft keel 006, the layup process may be further modified to achieve the additional inward offset relative to the mid keel 004.

In some embodiments, the staggered keel may be implemented using a combination of molding and assembly techniques. The main hull sections may be molded separately, with the keels 003, 004, and 006 manufactured as individual components. These keel components may then be precisely positioned and bonded to the hull during assembly, ensuring the correct staggered configuration.

For metal hulls, the staggered keel configuration may be achieved through a combination of forming and welding processes. The hull plates may be cut and shaped to the required dimensions, with the keel sections welded in place at the specified offsets. Precision jigs and fixtures may be used to maintain the correct positioning of the forward keel 003, mid keel 004, and aft keel 006 during the welding process.

In some embodiments, 3D printing technology may be employed for creating prototypes or even final components of the staggered keel design. This approach may allow for rapid iteration and testing of different keel configurations before full-scale production.

The manufacturing process may also involve careful quality control measures to ensure that the staggered keel configuration meets the design specifications. This may include the use of laser scanning or other measurement techniques to verify the positions and offsets of the forward keel 003, mid keel 004, and aft keel 006 relative to each other and the hull centerline.

In some embodiments, the catamaran hull may be designed to address common issues in traditional catamaran designs, such as the phenomena known as 'hunting'. Hunting is a condition where the hull overcorrects to the captain's inputs, resulting in a zigzag-like path instead of direct lines or arcs. The staggered keel configuration and varying deadrise angles of the catamaran hull may help to reduce this hunting phenomena, providing a smoother and more predictable response to steering inputs.

In some embodiments, the catamaran hull may provide improved sea-keeping abilities. Sea-keeping refers to the ability of a boat to remain comfortable and safe in various sea conditions. The staggered keel configuration and varying deadrise angles of the catamaran hull may contribute to better sea-keeping by improving the hull's stability and wave-cutting ability. This can result in a more comfortable ride for passengers and crew, particularly in rough waters.

In some embodiments, the catamaran hull may provide a dryer ride compared to traditional catamaran designs. A 'wet ride' is a condition where water spray is frequently thrown onto the deck and into the cockpit area, which can be uncomfortable for passengers and crew. The staggered keel configuration and varying deadrise angles of the catamaran hull may help to reduce this water spray, providing a dryer ride. This can be particularly beneficial in rough waters or at high speeds, where water spray is more likely to occur.

In some embodiments, the catamaran hull may provide improved handling and turning abilities. The staggered keel configuration and varying deadrise angles of the catamaran hull may contribute to better handling by improving the hull's response to steering inputs. This can result in more precise and predictable turns, enhancing the overall maneuverability of the catamaran.

In some embodiments, the catamaran hull may lean into turns rather than outward. Leaning outward during turns is a common issue with traditional catamaran designs, which can be uncomfortable for passengers and crew and can also affect the boat's stability. The staggered keel configuration and varying deadrise angles of the catamaran hull may help to reduce this outward lean, causing the catamaran to lean into turns instead. This can result in a more comfortable and stable ride during turns, enhancing the overall performance of the catamaran.

Those skilled in the art to which this application relates will appreciate that other and further additions, deletions, substitutions and modifications may be made to the described embodiments.

The specification is not to be taken in a limiting sense but is made merely for the purpose of describing the general principles of exemplary embodiments; many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

The invention is described with such embodiments, but the invention is not limited to any embodiment. The scope of the invention is limited only by the claims and the invention encompasses numerous alternatives, modifications and equivalents. Several specific details are set forth in the description to provide a thorough understanding of the invention.

These details are provided for the purpose of example and the invention may be practiced according to the claims without some or all of these specific details. In general, the order of the steps of disclosed processes may be altered within the scope of the invention.

Unless otherwise indicated, the drawings are intended to be read (e.g., arrangement of parts, proportion, degree, etc.) together with the specifications, and are to be considered a portion of the entire written description of this invention. As used in the preceding description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly", and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

What is claimed is:

1. A catamaran hull, comprising:

two parallel sponsons, each sponson having a staggered keel configuration;

wherein the staggered keel configuration comprises a forward keel centered on each sponson and a mid keel offset inward relative to the forward keel and an aft keel offset inward relative to the mid keel.

2. The catamaran hull of claim 1, further comprising at least one transverse step on each sponson.

3. The catamaran hull of claim 2, wherein the at least one transverse step is positioned between the forward keel and the mid keel.

4. The catamaran hull of claim 2, wherein the at least one transverse step is positioned between the mid keel and the aft keel.

5. The catamaran hull of claim 1, wherein the mid keel begins longitudinally at a forward transverse step and ends at an aft transverse step.

6. The catamaran hull of claim 1, wherein the aft keel begins longitudinally at an aft transverse step and ends at a stern.

7. A method of improving performance characteristics of a catamaran, comprising:

providing a catamaran hull with two parallel sponsons, each sponson having a staggered keel configuration;

positioning a forward keel centered on each sponson;

positioning a mid keel offset inward relative to the forward keel; and positioning an aft keel offset inward relative to the mid keel.

8. The method of claim 7, further comprising positioning at least one transverse step on each sponson.

9. The method of claim 8, wherein the at least one transverse step is positioned between the forward keel and the mid keel.

10. The method of claim 8, wherein positioning the at least one transverse step is between the mid keel and the aft keel.

11. The method of claim 7, wherein the mid keel is positioned to begin longitudinally at a forward transverse step and end at an aft transverse step.

12. The method of claim 7, wherein positioning the aft keel begins longitudinally at an aft transverse step and ends at a stern.

13. A catamaran hull system, comprising:

two parallel sponsons, each sponson comprising:

a forward keel centered on the sponson;

a mid keel offset inward relative to the forward keel;

an aft keel offset inward relative to the mid keel;

at least one transverse step positioned between the forward keel and the mid keel; and at least one transverse step positioned between the mid keel and the aft keel, wherein:

the mid keel begins longitudinally at a forward transverse step and ends at an aft transverse step;

the aft keel begins longitudinally at an aft transverse step and ends at the stern;

the mid keel is positioned inward relative to the forward keel by 1% to 15% of a submerged distance of a waterline; and the aft keel is positioned inward relative to the mid keel by 1% to 15% of the submerged distance of the waterline;

whereby the staggered keel configuration reduces hunting phenomena and improves sea-keeping, handling, and turning abilities of the catamaran.

* * * * *